US011737486B2

(12) United States Patent
Mohseni et al.

(10) Patent No.: US 11,737,486 B2
(45) Date of Patent: Aug. 29, 2023

(54) COMBUSTIBLE HEAT SOURCE COMPRISING AN IGNITION AID AND A BINDING AGENT

(71) Applicant: PHILIP MORRIS PRODUCTS S.A., Neuchatel (CH)

(72) Inventors: Farhang Mohseni, Neuchatel (CH); Simon Nussbaumer, Neuchatel (CH); Paola Orsolini, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 17/783,594

(22) PCT Filed: Dec. 14, 2020

(86) PCT No.: PCT/EP2020/085948

§ 371 (c)(1),
(2) Date: Jun. 8, 2022

(87) PCT Pub. No.: WO2021/122442

PCT Pub. Date: Jun. 24, 2021

(65) Prior Publication Data

US 2022/0369689 A1 Nov. 24, 2022

(30) Foreign Application Priority Data

Dec. 17, 2019 (EP) ..... 19217188

(51) Int. Cl.

| | |
|---|---|
| ***A24B 15/16*** | (2020.01) |
| ***A24D 1/22*** | (2020.01) |
| ***C10L 11/04*** | (2006.01) |

(52) U.S. Cl.

CPC ..... *A24B 15/165* (2013.01); *A24D 1/22* (2020.01); *C10L 11/04* (2013.01); *C10L 2200/0254* (2013.01); *C10L 2230/06* (2013.01); *C10L 2270/08* (2013.01)

(58) Field of Classification Search

None

See application file for complete search history.

(56) References Cited

U.S. PATENT DOCUMENTS

| | | | | |
|---|---|---|---|---|
| 5,443,560 | A | 8/1995 | Deevi | |
| 2015/0107759 | A1* | 4/2015 | Poget | A24D 1/22 156/245 |

(Continued)

FOREIGN PATENT DOCUMENTS

| | | |
|---|---|---|
| EP | 0 494 784 | 7/1992 |
| EP | 2 070 682 | 6/2009 |

(Continued)

OTHER PUBLICATIONS

PCT Search Report and Written Opinion for PCT/EP2020/085948 dated Mar. 4, 2021 (11 pages).

(Continued)

*Primary Examiner* — Dennis R Cordray

(74) *Attorney, Agent, or Firm* — Mueting Raasch Group

(57) ABSTRACT

A combustible heat source for an aerosol-generating article, the combustible heat source comprising: carbon; an alkaline earth metal peroxide ignition aid; and a binding agent comprising at least one non-cellulosic film-forming polymer.

16 Claims, 1 Drawing Sheet

(56) References Cited

U.S. PATENT DOCUMENTS

Figure 1:
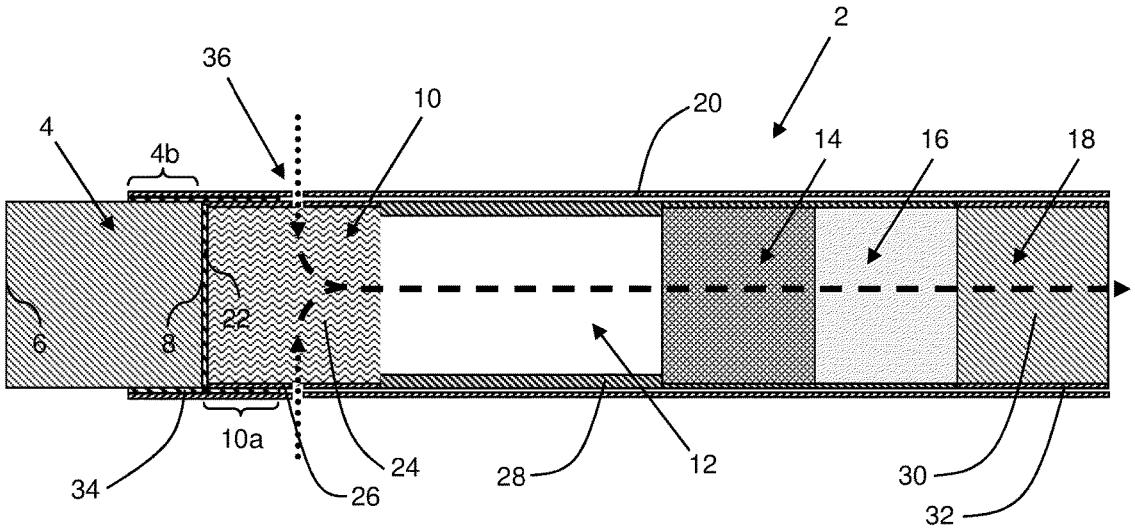

| | | | | |
|---|---|---|---|---|
| 2015/0157051 | A1* | 6/2015 | Mironov | A24C 5/00 131/328 |
| 2017/0055577 | A1* | 3/2017 | Batista | A24B 15/165 |
| 2019/0059450 | A1 | 2/2019 | Akiyama | |

FOREIGN PATENT DOCUMENTS

| | | |
|---|---|---|
| JP | 2005-295979 | 10/2005 |
| WO | WO 2009/022232 | 2/2009 |
| WO | WO 2009/074870 | 6/2009 |
| WO | WO 2012/164077 | 12/2012 |
| WO | WO 2014/006078 | 1/2014 |
| WO | WO 2014/086998 | 6/2014 |
| WO | WO 2015/022320 | 2/2015 |

OTHER PUBLICATIONS

International Preliminary Examination Report for PCT/EP2020/085948 dated Jan. 4, 2022 (14 pages).

Chan et al., "Prediction Models for Shape and Size of Ca-Alginate Macrobeads Produced through Extrusion-Dripping Method", Journal of Colloid and Interface Science, Academic Press, Inc., vol. 338, No. 1, Oct. 1, 2009, pp. 63-72.

Extended European Search Report for Application No. 19217188.2 dated Jun. 30, 2020 (8 pages).

* cited by examiner

COMBUSTIBLE HEAT SOURCE COMPRISING AN IGNITION AID AND A BINDING AGENT

This application is a U.S. National Stage Application of International Application No. PCT/EP2020/085948 filed Dec. 14, 2020, which was published in English on Jun. 24, 2021, as International Publication No. WO 2021/122442 A1. International Application No. PCT/EP2020/085948 claims priority to European Application No. 19217188.2 filed Dec. 17, 2019.

The present invention relates to a combustible heat source for an aerosol-generating article and to an aerosol-generating article comprising the combustible heat source and an aerosol-forming substrate downstream of the combustible heat source.

A number of aerosol-generating articles in which tobacco material is heated rather than combusted have been proposed in the art. An aim of such 'heated' aerosol-generating articles is to reduce known harmful smoke constituents of the type produced by the combustion and pyrolytic degradation of tobacco in conventional cigarettes.

Typically in heated aerosol-generating articles, an aerosol is generated by the transfer of heat from a heat source, for example, a chemical, electrical or combustible heat source, to a physically separate aerosol-forming substrate, which may be located within, around or downstream of the heat source.

In one type of heated aerosol-generating article, an aerosol is generated by the transfer of heat from a combustible carbonaceous heat source to a physically separate aerosol-forming substrate comprising tobacco material that is located downstream of the combustible carbonaceous heat source. In use, volatile compounds are released from the tobacco material by heat transfer to the aerosol-forming substrate from the combustible carbonaceous heat source and entrained in air drawn through the aerosol-generating article. As the released compounds cool, they condense to form an aerosol that is inhaled by the user.

Heat may be transferred from the combustible carbonaceous heat source to the aerosol-forming substrate by one or both of forced convection and conduction.

It is known to include a heat-conducting element around and in direct contact with at least a rear portion of the combustible carbonaceous heat source and at least a front portion of the aerosol-forming substrate of the heated aerosol-generating article in order to ensure sufficient conductive heat transfer from the combustible carbonaceous heat source to the aerosol-forming substrate to obtain an acceptable aerosol. For example, WO 2009/022232 A2 discloses a smoking article comprising a combustible carbonaceous heat source, an aerosol-forming substrate downstream of the combustible heat source, and a heat-conducting element around and in contact with a rear portion of the combustible carbonaceous heat source and an adjacent front portion of the aerosol-forming substrate. In use, heat generated during combustion of the combustible carbonaceous heat source is transferred to the periphery of the front portion of the aerosol-forming substrate by conduction through the abutting downstream end of the combustible carbonaceous heat source and the heat-conducting element.

The combustion temperature of a combustible heat source for use in a heated aerosol-generating article should not be so high as to result in combustion or thermal degradation of the aerosol-forming substrate during use of the heated aerosol-generating article. However, the combustion temperature of the combustible carbonaceous heat source should be sufficiently high to generate enough heat to release sufficient volatile compounds from the aerosol-forming substrate to produce an acceptable aerosol, especially during early puffs.

A variety of combustible carbonaceous heat sources for use in heated aerosol-generating articles are known in the art.

When used in heated aerosol-generating articles, known combustible carbonaceous heat sources often do not generate enough heat after ignition thereof to produce an acceptable aerosol during early puffs.

When used in heated aerosol-generating articles, known combustible carbonaceous heat sources are often difficult to ignite. Failure to properly ignite a combustible carbonaceous heat source of a heated aerosol-generating article may lead to an unacceptable aerosol being delivered to a user.

It has been proposed to include oxidizing agents and other additives in combustible carbonaceous heat sources in order to improve the ignition and combustion properties thereof. For example, WO 2012/164077 A1 discloses a combustible heat source for a smoking article comprising carbon and at least one ignition aid selected from the group consisting of metal nitrate salts having a thermal decomposition temperature of less than about 600 degrees Celsius, chlorates, peroxides, thermitic materials, intermetallic materials, magnesium, zirconium, and combinations thereof.

Some ignition aids used in known combustible carbonaceous heat sources have been found to decompose upon exposure to environmental conditions during transport and storage of combustible carbonaceous heat sources. For example, some ignition aids used in known combustible carbonaceous heat sources have been found to decompose upon exposure to atmospheric moisture during transport and storage of the combustible carbonaceous heat sources. Decomposition of an ignition aid during transport and storage may disadvantageously make known carbonaceous combustible heat sources comprising the ignition aid source more difficult to ignite.

It would be desirable to provide a combustible carbonaceous heat source comprising an ignition aid that exhibits rapid ignition and mechanical integrity even after exposure to environmental conditions.

It would be desirable to provide a combustible carbonaceous heat source comprising an ignition aid that exhibits improved combustion properties compared to known combustible carbonaceous heat sources comprising an ignition aid.

The invention relates to a combustible heat source for an aerosol-generating article. The combustible heat source may comprise carbon. The combustible heat source may comprise an ignition aid. The ignition aid may be an alkaline earth metal peroxide. The combustible heat source may comprise a binding agent. The binding agent may comprise at least one non-cellulosic film-forming polymer.

According to the invention there is provided a combustible heat source for aerosol-generating article, the combustible heat source comprising: carbon; an alkaline earth metal peroxide ignition aid; and a binding agent comprising at least one non-cellulosic film-forming polymer.

According to the invention there is further provided an aerosol-generating article comprising: a combustible heat source according to the invention; and an aerosol-forming substrate downstream of the combustible heat source.

It has been surprisingly found that inclusion of a binding agent comprising at least one non-cellulosic film-forming polymer in combustible heat sources according to the invention may advantageously reduce degradation of the alkaline earth metal peroxide ignition aid as a result of exposure to environmental conditions.

In particular, it has been surprisingly found that inclusion of a binding agent comprising at least one non-cellulosic film-forming polymer in combustible heat sources according to the invention may reduce degradation of the alkaline earth metal peroxide ignition aid as a result of exposure to high humidity.

Without wishing to be bound by theory, it is believed that inclusion of a binding agent comprising at least one non-cellulosic film-forming polymer creates a barrier to moisture diffusion into combustible heat sources according to the invention.

By reducing degradation of the alkaline earth metal peroxide ignition aid, inclusion of a binding agent comprising at least one non-cellulosic film-forming polymer may advantageously improve the chemical and physical stability of combustible heat sources according to the invention during transport and storage of the combustible heat sources.

It has also been surprisingly found that inclusion of a binding agent comprising at least one non-cellulosic film-forming polymer in combination with an alkaline earth metal peroxide ignition aid may advantageously significantly improve the combustion properties of combustible heat sources according to the invention.

In particular, it has been surprisingly found that inclusion of a binding agent comprising at least one non-cellulosic film-forming polymer may advantageously significantly improve the ignition propagation speed of combustible heat sources according to the invention.

Without wishing to be bound by theory, it is believed that the binding agent comprising at least one non-cellulosic film-forming polymer provides energy during ignition of combustible heat sources according to the invention. Without wishing to be bound by theory, it is believed that this improves the ignition propagation speed of combustible heat sources according to the invention.

It has also been surprisingly found that inclusion of a binding agent comprising at least one non-cellulosic film-forming polymer may advantageously significantly improve the mechanical properties of combustible heat sources according to the invention.

Without wishing to be bound by theory, it is believed that inclusion of a binding agent comprising at least one non-cellulosic film-forming polymer modifies agglomeration of the carbon and alkaline earth metal peroxide ignition aid during formation of combustible heat sources according to the invention. Without wishing to be bound by theory, it is believed that this affects the mechanical properties of combustible heat sources according to the invention.

As used herein with reference to the invention, the terms "distal", "upstream" and "front" and the terms "proximal", "downstream" and "rear" are used to describe the relative positions of components, or portions of components, of aerosol-generating articles according to the invention. Aerosol-generating articles according to the invention comprise a proximal end through which, in use, an aerosol exits the aerosol-generating article for delivery to a user. The proximal end of the aerosol-generating article may also be referred to as the mouth end of the aerosol-generating article. In use, a user draws on the proximal end of the aerosol-generating article in order to inhale an aerosol generated by the aerosol-generating article.

Aerosol-generating articles according to the invention comprise a distal end. The combustible heat source is located at or proximate to the distal end of the aerosol-generating article. The mouth end of the aerosol-generating article is downstream of the distal end of the aerosol-generating article. The proximal end of the aerosol-generating article may also be referred to as the downstream end of the aerosol-generating article and the distal end of the aerosol-generating article may also be referred to as upstream end of the aerosol-generating article. Components, or portions of components, of aerosol-generating articles according to the invention may be described as being upstream or downstream of one another based on their relative positions between the proximal end of the aerosol-generating article and the distal end of the aerosol-generating article.

Combustible heat sources according to the invention have a front end face and a rear end face. The front end face of the combustible heat source is at the upstream end of the combustible heat source. The upstream end of the combustible heat source is the end of the combustible heat source furthest from the proximal end of the aerosol-generating article. The rear end face of the combustible heat source is at the downstream end of the combustible heat source. The downstream end of the combustible heat source is the end of the combustible heat source closest to the proximal end of the aerosol-generating article.

As used herein with reference to the invention, the term "longitudinal" is used to describe the direction between the upstream end and the downstream end of combustible heat sources according to the invention and aerosol-generating articles according to the invention.

As used herein with reference to the invention, the term "transverse" is used to describe the direction perpendicular to the longitudinal direction. That is, the direction perpendicular to the direction between the upstream end and the downstream end of combustible heat sources according to the invention and aerosol-generating articles according to the invention.

As used herein with reference to the invention, the term "length" is used to describe the maximum dimension in the longitudinal direction of combustible heat sources according to the invention and aerosol-generating articles according to the invention.

As used herein with reference to the invention, the term "diameter" is used to describe the maximum dimension in the transverse direction of combustible heat sources according to the invention and aerosol-generating articles according to the invention.

Combustible heat sources according to the invention are carbonaceous heat sources.

As used herein with reference to the invention, the term "carbonaceous" is used to describe a combustible heat source comprising carbon.

Combustible heat sources according to the invention comprise carbon as a fuel.

The combustible heat source may comprise at least about 25 percent by weight of carbon.

Unless stated otherwise, percentages by weight of components of the combustible heat source recited herein are based on the total dry weight of the combustible heat source.

Preferably, the combustible heat source comprises at least about 30 percent by weight of carbon.

More preferably, the combustible heat source comprises at least about 35 percent by weight of carbon.

The combustible heat source may comprise at least about 40 percent by weight of carbon.

The combustible heat source may comprise less than or equal to about 60 percent by weight of carbon.

Preferably, the combustible heat source comprises less than or equal to about 55 percent by weight of carbon.

More preferably, the combustible heat source comprises less than or equal to about 50 percent by weight of carbon.

The combustible heat source may comprise less than or equal to about 45 percent by weight of carbon.

The combustible heat source may comprise between about 25 percent by weight and about 60 percent by weight of carbon, between about 25 percent by weight and about 55 percent by weight of carbon, between about 25 percent by weight and about 50 percent by weight of carbon or between about 25 percent by weight and about 45 percent by weight of carbon.

Preferably, the combustible heat source comprises between about 30 percent by weight and about 60 percent by weight of carbon, between about 30 percent by weight and about 55 percent by weight of carbon, between about 30 percent by weight and about 50 percent by weight of carbon or between about 30 percent by weight and about 45 percent by weight of carbon.

More preferably, the combustible heat source comprises between about 35 percent by weight and about 60 percent by weight of carbon, between about 35 percent by weight and about 55 percent by weight of carbon, between about 35 percent by weight and about 50 percent by weight of carbon or between about 35 percent by weight and about 45 percent by weight of carbon.

The combustible heat source may comprise between about 40 percent by weight and about 60 percent by weight of carbon, between about 40 percent by weight and about 55 percent by weight of carbon, between about 40 percent by weight and about 50 percent by weight of carbon or between about 40 percent by weight and about 45 percent by weight of carbon.

Combustible heat sources according to the invention may be formed using one or more suitable carbon materials. Advantageously, combustible heat sources according to the invention comprise one or more carbonised materials. Suitable carbon materials are well known in the art and include, but are not limited to, carbon powder and charcoal powder.

Combustible heat sources according to the invention comprise an alkaline earth metal peroxide ignition aid.

As used herein with reference to the invention, the term "alkaline earth metal peroxide ignition aid" is used to describe an alkaline earth metal peroxide that releases one or both of energy and oxygen during ignition of the combustible heat source, where the rate of release of one or both of energy and oxygen by the alkaline earth metal peroxide is not ambient oxygen diffusion limited. In other words, the rate of release of one or both of energy and oxygen by the alkaline earth metal peroxide during ignition of the combustible heat source is largely independent of the rate at which ambient oxygen can reach the alkaline earth metal peroxide.

The quantity of one or both of energy and oxygen released by the alkaline earth metal peroxide ignition aid during ignition of the combustible heat source may be sufficient to result in the combustible heat source undergoing a two-stage combustion process.

In an initial first stage combustible heat sources according to the invention may exhibit a 'boost' in temperature and in a subsequent second stage combustible heat sources according to the invention may undergo sustained combustion at a lower 'cruising' temperature.

The initial 'boost' in temperature of combustible heat sources according to the invention may arise due to very rapid propagation of heat throughout the entirety of the combustible heat sources upon ignition of a portion thereof. The very rapid propagation of heat may be the result of a chain reaction in which a portion of the combustible heat source that is ignited triggers the ignition of an adjacent unignited part of the combustible heat source.

In use in aerosol-generating articles according to the invention, the rapid increase in temperature of the combustible heat source according to the invention to the 'boost' temperature may quickly raise the temperature of the aerosol-forming substrate to a level at which volatile compounds are released from the aerosol-forming substrate. This may ensure that aerosol-generating articles according to the invention produce a sensorially acceptable aerosol during early puffs. The subsequent decrease in temperature of the combustible heat source according to the invention to the 'cruising' temperature may ensure that the temperature of the aerosol-forming substrate does not reach a level at which combustion or thermal degradation of the aerosol-forming substrate occurs.

Controlling the temperature of combustible heat sources according to the invention in the manner described above may advantageously enable aerosol-generating articles according to the invention to be provided that not only produce a sensorially acceptable aerosol during early puffs, but in which combustion or thermal degradation of the aerosol-forming substrate is also substantially avoided.

The amount of alkaline earth metal peroxide ignition aid that must be included in order to achieve the two-stage process described above will vary depending on the specific alkaline earth metal peroxide ignition aid included in the combustible heat source.

In general, the greater the quantity of one or both of energy and oxygen released by the alkaline earth metal peroxide ignition aid per unit mass thereof, the lower the amount of the alkaline earth metal peroxide ignition aid that must be included in the combustible heat source in order to achieve the two-stage combustion process described above.

The combustible heat source may comprise at least about 15 percent by weight of the alkaline earth metal peroxide ignition aid.

Preferably, the combustible heat source comprises at least about 20 percent by weight of the alkaline earth metal peroxide ignition aid.

More preferably, the combustible heat source comprises at least about 30 percent by weight of the alkaline earth metal peroxide ignition aid.

The combustible heat source may comprise at least about 40 percent by weight of the alkaline earth metal peroxide ignition aid.

The combustible heat source may comprise less than or equal to about 65 percent by weight of the alkaline earth metal peroxide ignition aid.

Preferably, the combustible heat source comprises less than or equal to about 60 percent by weight of the alkaline earth metal peroxide ignition aid.

More preferably, the combustible heat source comprises less than or equal to about 55 percent by weight of the alkaline earth metal peroxide ignition aid.

The combustible heat source may comprise less than or equal to about 50 percent by weight of the alkaline earth metal peroxide ignition aid.

The combustible heat source may comprise between about 15 percent by weight and about 65 percent by weight of the alkaline earth metal peroxide ignition aid, between about 15 percent by weight and about 60 percent by weight of the alkaline earth metal peroxide ignition aid, between about 15 percent by weight and about 55 percent by weight of the alkaline earth metal peroxide ignition aid or between about 15 percent by weight and about 50 percent by weight of the alkaline earth metal peroxide ignition aid.

Preferably, the combustible heat source comprises between about 20 percent by weight and about 65 percent by weight of the alkaline earth metal peroxide ignition aid, between about 20 percent by weight and about 60 percent by weight of the alkaline earth metal peroxide ignition aid, between about 20 percent by weight and about 55 percent by weight of the alkaline earth metal peroxide ignition aid or between about 20 percent by weight and about 50 percent by weight of the alkaline earth metal peroxide ignition aid.

More preferably, the combustible heat source comprises between about 30 percent by weight and about 65 percent by weight of the alkaline earth metal peroxide ignition aid, between about 30 percent by weight and about 60 percent by weight of the alkaline earth metal peroxide ignition aid, between about 30 percent by weight and about 55 percent by weight of the alkaline earth metal peroxide ignition aid or between about 30 percent by weight and about 50 percent by weight of the alkaline earth metal peroxide ignition aid.

The combustible heat source may comprise between about 40 percent by weight and about 65 percent by weight of the alkaline earth metal peroxide ignition aid, between about 40 percent by weight and about 60 percent by weight of the alkaline earth metal peroxide ignition aid, between about 40 percent by weight and about 55 percent by weight of the alkaline earth metal peroxide ignition aid or between about 40 percent by weight and about 50 percent by weight of the alkaline earth metal peroxide ignition aid.

Preferably, the alkaline earth metal peroxide ignition aid is calcium peroxide.

The combustible heat source may comprise at least about 15 percent by weight of calcium peroxide.

Preferably, the combustible heat source comprises at least about 20 percent by weight of calcium peroxide.

More preferably, the combustible heat source comprises at least about 30 percent by weight of calcium peroxide.

The combustible heat source may comprise at least about 40 percent by weight of calcium peroxide.

The combustible heat source may comprise less than or equal to about 65 percent by weight of calcium peroxide.

Preferably, the combustible heat source comprises less than or equal to about 60 percent by weight of calcium peroxide.

More preferably, the combustible heat source comprises less than or equal to about 55 percent by weight of calcium peroxide.

The combustible heat source may comprise less than or equal to about 50 percent by weight of calcium peroxide.

The combustible heat source may comprise between about 15 percent by weight and about 65 percent by weight of calcium peroxide, between about 15 percent by weight and about 60 percent by weight of calcium peroxide, between about 15 percent by weight and about 55 percent by weight of calcium peroxide or between about 15 percent by weight and about 50 percent by weight of calcium peroxide.

Preferably, the combustible heat source comprises between about 20 percent by weight and about 65 percent by weight of calcium peroxide, between about 20 percent by weight and about 60 percent by weight of calcium peroxide, between about 20 percent by weight and about 55 percent by weight of calcium peroxide or between about 20 percent by weight and about 50 percent by weight of calcium peroxide.

More preferably, the combustible heat source comprises between about 30 percent by weight and about 65 percent by weight of calcium peroxide, between about 30 percent by weight and about 60 percent by weight of calcium peroxide, between about 30 percent by weight and about 55 percent by weight of calcium peroxide or between about 30 percent by weight and about 50 percent by weight of calcium peroxide.

The combustible heat source may comprise between about 40 percent by weight and about 65 percent by weight of calcium peroxide, between about 40 percent by weight and about 60 percent by weight of calcium peroxide, between about 40 percent by weight and about 55 percent by weight of calcium peroxide or between about 40 percent by weight and about 50 percent by weight of calcium peroxide.

Combustible heat sources according to the invention are solid combustible heat sources.

Preferably, combustible heat sources are monolithic solid combustible heat sources. That is, one-piece solid combustible heat sources.

Combustible heat sources according to the invention comprise a binding agent comprising at least one non-cellulosic film-forming polymer.

As used herein with reference to the invention, the term "binding agent" is used to describe a component of the combustible heat source that is capable of binding the carbon and the alkaline earth metal peroxide ignition aid and any other components of the combustible heat source together.

The combustible heat source may comprise at least about 3 percent by weight of the binding agent.

Preferably, the combustible heat source comprises at least about 4 percent by weight of the binding agent.

More preferably, the combustible heat source comprises at least about 5 percent by weight of the binding agent.

The combustible heat source may comprise less than or equal to about 20 percent by weight of the binding agent.

Preferably, the combustible heat source comprises less than or equal to about 15 percent by weight of the binding agent.

More preferably, the combustible heat source comprises less than or equal to about 10 percent by weight of the binding agent.

The combustible heat source may comprise between about 3 percent by weight and about 20 percent by weight of the binding agent, between about 3 percent by weight and about 15 percent by weight of the binding agent or between about 3 percent by weight and about 10 percent by weight of the binding agent.

Preferably, the combustible heat source comprises between about 4 percent by weight and about 20 percent by weight of the binding agent, between about 4 percent by weight and about 15 percent by weight of the binding agent or between about 4 percent by weight and about 10 percent by weight of the binding agent.

More preferably, the combustible heat source comprises between about 5 percent by weight and about 20 percent by weight of the binding agent, between about 5 percent by weight and about 15 percent by weight of the binding agent or between about 5 percent by weight and about 10 percent by weight of the binding agent.

The binding agent comprises at least one non-cellulosic film-forming polymer.

As used herein with reference to the invention, the term "non-cellulosic film-forming polymer" is used to describe a non-cellulosic polymer that is capable of forming a film upon application to a solid surface.

As used herein with reference to the invention, the term "non-cellulosic film-forming polymer" does not include modified celluloses and cellulose derivatives, such as methyl cellulose, carboxymethyl cellulose, hydroxypropyl cellulose and hydroxypropyl methylcellulose.

Preferably, the at least one non-cellulosic film-forming polymer is selected from the group consisting of polyvinyl alcohol, polyethylene glycol, polyvinylpyrrolidone, polyvinyl acetate and graft-copolymers thereof.

The combustible heat source may comprise at least about 0.5 percent by weight of the at least one non-cellulosic film-forming polymer.

Preferably, the combustible heat source comprises at least about 0.75 percent by weight of the at least one non-cellulosic film-forming polymer.

More preferably, the combustible heat source comprises at least about 1 percent by weight of the at least one non-cellulosic film-forming polymer.

The combustible heat source may comprise less than or equal to about 5 percent by weight of the at least one non-cellulosic film-forming polymer.

Preferably, the combustible heat source comprises less than or equal to about 4 percent by weight of the at least one non-cellulosic film-forming polymer.

More preferably, the combustible heat source comprises less than or equal to about 3 percent by weight of the at least one non-cellulosic film-forming polymer.

The combustible heat source may comprise between about 0.5 percent by weight and about 5 percent by weight of the at least one non-cellulosic film-forming polymer, between about 0.5 percent by weight and about 4 percent by weight of the at least one non-cellulosic film-forming polymer, or between about 0.5 percent by weight and about 3 percent by weight of the at least one non-cellulosic film-forming polymer.

Preferably, the combustible heat source comprises between about 0.75 percent by weight and about 5 percent by weight of the at least one non-cellulosic film-forming polymer, between about 0.75 percent by weight and about 4 percent by weight of the at least one non-cellulosic film-forming polymer, or between about 0.75 percent by weight and about 3 percent by weight of the at least one non-cellulosic film-forming polymer.

More preferably, the combustible heat source comprises between about 1 percent by weight and about 5 percent by weight of the at least one non-cellulosic film-forming polymer, between about 1 percent by weight and about 4 percent by weight of the at least one non-cellulosic film-forming polymer, or between about 1 percent by weight and about 3 percent by weight of the at least one non-cellulosic film-forming polymer.

Preferably, combustible heat sources according to the invention comprise a binding agent comprising a combination of at least one cellulose ether and at least one non-cellulosic film-forming polymer.

More preferably, combustible heat sources according to the invention comprise a binding agent comprising a combination of: at least one cellulose ether selected from the group consisting of carboxymethyl cellulose, ethyl cellulose, methyl cellulose, hydroxyethyl cellulose, hydroxypropyl cellulose, and hydroxypropyl methylcellulose; and at least one non-cellulosic film-forming polymer.

Most preferably, combustible heat sources according to the invention comprise a binding agent comprising a combination of carboxymethyl cellulose and at least one non-cellulosic film-forming polymer.

Combustible heat sources according to the invention may comprise a binding agent comprising a combination of: carboxymethyl cellulose; at least one additional cellulose ether; and at least one non-cellulosic film-forming polymer.

As used herein with reference to the invention, the term "additional cellulose ether" is used to describe a cellulose ether other than carboxymethyl cellulose.

Preferably, combustible heat sources according to the invention comprise a binding agent comprising a combination of: at least one cellulose ether; and at least one non-cellulosic film-forming polymer selected from the group consisting of polyvinyl alcohol, polyethylene glycol, polyvinylpyrrolidone, polyvinyl acetate and graft-copolymers thereof.

More preferably, combustible heat sources according to the invention comprise a binding agent comprising a combination of: at least one cellulose ether selected from the group consisting of carboxymethyl cellulose, ethyl cellulose, methyl cellulose, hydroxyethyl cellulose, hydroxypropyl cellulose, and hydroxypropyl methylcellulose; and at least one non-cellulosic film-forming polymer selected from the group consisting of polyvinyl alcohol, polyethylene glycol, polyvinylpyrrolidone, polyvinyl acetate and graft-copolymers thereof.

Most preferably, combustible heat sources according to the invention comprise a binding agent comprising a combination of carboxymethyl cellulose and at least one non-cellulosic film-forming polymer selected from the group consisting of polyvinyl alcohol, polyethylene glycol, polyvinylpyrrolidone, polyvinyl acetate and graft-copolymers thereof.

Combustible heat sources according to the invention may comprise a binding agent comprising a combination of: carboxymethyl cellulose; at least one additional cellulose ether; and at least one non-cellulosic film-forming polymer selected from the group consisting of polyvinyl alcohol, polyethylene glycol, polyvinylpyrrolidone, polyvinyl acetate and graft-copolymers thereof.

Combustible heat sources according to the invention may comprise a binding agent comprising a combination of: carboxymethyl cellulose; at least one additional cellulose ether selected from the group consisting of ethyl cellulose, methyl cellulose, hydroxyethyl cellulose, hydroxypropyl cellulose, and hydroxypropyl methylcellulose; and at least one non-cellulosic film-forming polymer selected from the group consisting of polyvinyl alcohol, polyethylene glycol, polyvinylpyrrolidone, polyvinyl acetate and graft-copolymers thereof.

The combustible heat source may comprise at least about 1.5 percent by weight of carboxymethyl cellulose.

Preferably, the combustible heat source comprises at least about 2 percent by weight of carboxymethyl cellulose.

More preferably, the combustible heat source comprises at least about 3 percent by weight of carboxymethyl cellulose.

The combustible heat source may comprise less than or equal to about 15 percent by weight of carboxymethyl cellulose.

Preferably, the combustible heat source comprises less than or equal to about 12 percent by weight of carboxymethyl cellulose.

More preferably, the combustible heat source comprises less than or equal to about 8 percent by weight of carboxymethyl cellulose.

The combustible heat source may comprise between about 1.5 percent by weight and about 15 percent by weight of carboxymethyl cellulose, between about 1.5 percent by weight and about 12 percent by weight of carboxymethyl cellulose or between about 1.5 percent by weight and about 8 percent by weight of carboxymethyl cellulose.

Preferably, the combustible heat source comprises between about 2 percent by weight and about 15 percent by weight of carboxymethyl cellulose, between about 2 percent by weight and about 12 percent by weight of carboxymethyl cellulose, or between about 2 percent by weight and about 8 percent by weight of carboxymethyl cellulose.

More preferably, the combustible heat source comprises between about 3 percent by weight and about 15 percent by weight of carboxymethyl cellulose, between about 3 percent by weight and about 12 percent by weight of carboxymethyl cellulose, or between about 3 percent by weight and about 8 percent by weight of carboxymethyl cellulose.

The ratio of the percentage by weight of carboxymethyl cellulose to the percentage by weight of the at least one non-cellulosic film-forming polymer in the combustible heat source may be at least about 1:1.

Preferably, the ratio of the percentage by weight of carboxymethyl cellulose to the percentage by weight of the at least one non-cellulosic film-forming polymer in the combustible heat source is at least about 3:2.

More preferably, the ratio of the percentage by weight of carboxymethyl cellulose to the percentage by weight of the at least one non-cellulosic film-forming polymer in the combustible heat source is at least about 2:1.

The ratio of the percentage by weight of carboxymethyl cellulose to the percentage by weight of the at least one non-cellulosic film-forming polymer in the combustible heat source may be less than or equal to about 4:1.

Preferably, the ratio of the percentage by weight of carboxymethyl cellulose to the percentage by weight of the at least one non-cellulosic film-forming polymer in the combustible heat source is less than or equal to about 7:2.

More preferably, the ratio of the percentage by weight of carboxymethyl cellulose to the percentage by weight of the at least one non-cellulosic film-forming polymer in the combustible heat source is less than or equal to about 3:1.

The ratio of the percentage by weight of carboxymethyl cellulose to the percentage by weight of the at least one non-cellulosic film-forming polymer in the combustible heat source may be less than or equal to about 5:2.

The ratio of the percentage by weight of carboxymethyl cellulose to the percentage by weight of the at least one non-cellulosic film-forming polymer in the combustible heat source may be between about 1:1 and about 4:1, between about 1:1 and about 7:2, between about 1:1 and about 3:1 or between about 1:1 and about 5:2.

Preferably, the ratio of the percentage by weight of carboxymethyl cellulose to the percentage by weight of the at least one non-cellulosic film-forming polymer in the combustible heat source is between about 3:2 and about 4:1, between about 3:2 and about 7:2, between about 3:2 and about 3:1 or between about 3:2 and about 5:2.

More preferably, the ratio of the percentage by weight of carboxymethyl cellulose to the percentage by weight of the at least one non-cellulosic film-forming polymer in the combustible heat source is between about 2:1 and about 4:1, between about 2:1 and about 7:2, between about 2:1 and about 3:1 or between about 2:1 and about 5:2.

The binding agent may comprise a non-combustible inorganic sheet silicate binder.

As used herein with reference to the invention, the term "non-combustible" is used to describe a component that does not burn or decompose at temperatures reached during ignition and combustion of the combustible heat source.

As used herein with reference to the invention, the term "non-combustible inorganic sheet silicate binder" is used to describe an inorganic sheet silicate binder that is stable at temperatures to which the binding agent is subjected during ignition and burning of the combustible heat source and will remain substantially intact during and after burning of the combustible heat source.

Suitable non-combustible inorganic sheet silicate binders include, but are not limited to: clays, such as bentonite, montmorillonite, and kaolinite; micas; and serpentines.

As used herein with reference to the invention, the term "clay" is used to describe aluminium phyllosilicate materials formed of two dimensional sheets of silicate and aluminate ions, which form a distinct layered structure within the clay.

Advantageously, the binding agent may not comprise a non-combustible inorganic sheet silicate binder.

Combustible heat sources according to the invention may comprise one or more carboxylate burn salts.

As used herein with reference to the invention, the term "carboxylate burn salt" is used to describe a salt of a carboxylic acid other than carbonic acid. That is, as used herein with reference to the invention, the term "carboxylate burn salt" does not include carbonates or bicarbonates.

The one or more carboxylate burn salts may advantageously promote combustion of the combustible heat source.

The carboxylate burn salt may comprise a monovalent, divalent, or trivalent cation and a carboxylate anion.

The carboxylate burn salt may comprise a monovalent, divalent, or trivalent cation and an acetate, citrate or succinate anion.

The carboxylate burn salt may be an alkali metal carboxylate burn salt. For example, the carboxylate burn salt may be a sodium carboxylate burn salt or a potassium carboxylate burn salt.

The carboxylate burn salt may be an alkali metal acetate, an alkali metal citrate or an alkali metal succinate.

Most preferably, the carboxylate burn salt is potassium citrate.

The combustible heat source may comprise a single carboxylate burn salt.

The combustible heat source may comprise a combination of two or more different carboxylate burn salts. The two or more different carboxylate burn salts may comprise different carboxylate anions. The two or more different carboxylate burn salts may comprise different cations. For example, the combustible heat source may comprise a combination of an alkali metal citrate and an alkaline earth metal succinate.

The combustible heat source may comprise at least about 0.1 percent by weight of the one or more carboxylate burn salts.

The combustible heat source may comprise at least about 0.5 percent by weight of the one or more carboxylate burn salts.

Preferably, the combustible heat source comprises at least about 1 percent by weight of the one or more carboxylate burn salts.

The combustible heat source may comprise less than or equal to about 4 percent by weight of the one or more carboxylate burn salts.

Preferably, the combustible heat source comprises less than or equal to about 3 percent by weight of the one or more carboxylate burn salts.

The combustible heat source may comprise between about 0.1 percent by weight and about 4 percent by weight of the one or more carboxylate burn salts or between about 0.1 percent by weight and about 3 percent by weight of the one or more carboxylate burn salts.

The combustible heat source may comprise between about 0.5 percent by weight and about 4 percent by weight of the one or more carboxylate burn salts or between about 0.5 percent by weight and about 3 percent by weight of the one or more carboxylate burn salts.

Preferably, the combustible heat source comprises between about 1 percent by weight and about 4 percent by weight of the one or more carboxylate burn salts or between about 1 percent by weight and about 3 percent by weight of the one or more carboxylate burn salts.

Preferably, combustible heat sources according to the invention are substantially homogeneous in composition.

Combustible heat sources according to the invention may have any desired length.

Combustible heat sources according to the invention may have a length of between about 5 millimetres and about 20 millimetres.

Preferably, combustible heat sources according to the invention have a length of between about 7 millimetres and about 17 millimetres.

More preferably, combustible heat sources according to the invention have a length of between about 7 millimetres and about 15 millimetres.

Most preferably, combustible heat sources according to the invention have a length of between about 7 millimetres and about 13 millimetres.

Combustible heat sources according to the invention may have any desired diameter.

Combustible heat sources according to the invention may have a diameter of between about 5 millimetres and about 15 millimetres.

Preferably, combustible heat sources according to the invention have a diameter of between about 5 millimetres and about 10 millimetres.

More preferably, combustible heat sources according to the invention have a diameter of between about 7 millimetres and about 8 millimetres.

Combustible heat sources according to the invention may be tapered so that the diameter of a rear portion of the combustible heat source is greater than the diameter of a front portion of the combustible heat source.

Preferably, combustible heat sources according to the invention are of substantially constant diameter.

Preferably, combustible heat sources according to the invention are of substantially circular transverse cross-section.

Preferably, combustible heat sources according to the invention are substantially cylindrical.

Combustible heat sources according to the invention may have a mass of between about 300 milligrams and about 500 milligrams. For example, combustible heat sources according to the invention have a mass of between about 400 milligrams and about 450 milligrams.

Combustible heat sources according to the invention may have an apparent density of between about 0.6 grams per cubic centimetre and about 1.0 gram per cubic centimetre.

Combustible heat sources according to the invention may have a porosity of between about 20 percent and about 80 percent as measured by, for example, mercury porosimetry or helium pycnometry.

For example, combustible heat sources according to the invention may have a porosity of between about 20 percent and 60 percent, between about 50 percent and about 70 percent, or between about 50 percent and about 60 percent as measured by, for example, mercury porosimetry or helium pycnometry.

A desired porosity may be readily achieved during production of combustible heat sources according to the invention using conventional methods and technology.

Combustible heat sources according to the invention may be formed by: combining one or more carbon materials, the alkaline earth metal peroxide ignition aid, the binding agent and any other components of the combustible heat source to form a mixture; and forming the mixture into a desired shape.

Preferably, combustible heat sources according to the invention are formed by: combining one or more carbon materials, the alkaline earth metal peroxide ignition aid, the binding agent and any other components of the combustible heat source to form a granulate mixture; and forming the granulate mixture into a desired shape.

Advantageously, the binding agent is dispersed in intergranular and intra-granular positions in the granulate mixture.

The one or more carbon materials, the alkaline earth metal peroxide ignition aid, the binding agent and any other components of the combustible heat source may be combined to form a mixture using suitable known methods such as, for example, dry granulation, wet granulation, high shear mixing, spheronization or extrusion.

Preferably, the one or more carbon materials, the alkaline earth metal peroxide ignition aid, the binding agent and any other components of the combustible heat source are combined to form a granulate mixture by wet granulation.

The mixture may be formed into a desired shape using suitable known ceramic forming methods such as, for example, slip casting, extrusion, injection moulding, die compaction or pressing.

Preferably, the mixture is formed into a desired shape by pressing.

Preferably, after formation the desired shape is dried to reduce the moisture content thereof. The desired shape may be dried using suitable known methods. For example, the desired shape may be dried in an oven at a temperature of between about 85 degrees Celsius and about 105 degrees Celsius.

The combustible heat source may be a non-blind combustible heat source.

As used herein with reference to the invention, the term "non-blind" is used to describe a combustible heat source including at least one airflow channel extending along the length of the combustible heat source through which air may be drawn for inhalation by a user.

Where the combustible heat source is a non-blind combustible heat source, a non-combustible substantially air-impermeable barrier may be provided between the non-blind combustible heat source and the at least one airflow channel.

As used herein with reference to the invention, the term "non-combustible barrier" is used to describe a barrier that is substantially non-combustible at temperatures reached by the combustible heat source during ignition and combustion thereof.

Inclusion of a non-combustible substantially air impermeable barrier between the non-blind combustible heat source and the at least one airflow channel may, in use, advantageously substantially prevent or inhibit combustion and decomposition products formed during ignition and combustion of the non-blind combustible heat source from entering air drawn through at least one airflow channel.

In use, inclusion of a non-combustible, substantially air-impermeable barrier between the non-blind combustible heat source and the at least one airflow channel may advantageously substantially prevent or inhibit activation of combustion of the non-blind combustible heat source during puffing by a user. When used in an aerosol-generating article according to the invention, this may advantageously substantially prevent or inhibit spikes in the temperature of the aerosol-forming substrate of the aerosol-generating article during puffing by a user.

The barrier between the non-blind combustible heat source and the at least one airflow channel may have a low thermal conductivity or a high thermal conductivity.

The thickness of the barrier between the non-blind combustible heat source and the at least one airflow channel may be selected to achieve good performance.

The barrier between the non-blind combustible heat source and the at least one airflow channel may be formed from one or more suitable materials that are substantially thermally stable and non-combustible at temperatures achieved by the non-blind combustible heat source during ignition and combustion thereof. Suitable materials are known in the art and include, but are not limited to: clays; metal oxides, such as iron oxide, alumina, titania, silica, silica-alumina, zirconia and ceria; zeolites; zirconium phosphate and other ceramic materials; and combinations thereof.

The barrier between the non-blind combustible heat source and the at least one airflow channel may be adhered or otherwise affixed to the inner surface of the at least one airflow channel of the non-blind combustible heat source.

Suitable methods for adhering or affixing a barrier to the inner surface of the at least one airflow channel of the non-blind combustible heat source are known in the art and include, but are not limited to, the methods described in U.S. Pat. No. 5,040,551 and WO 2009/074870 A2.

The barrier between the non-blind combustible heat source and the at least one airflow channel may comprise a liner inserted into the at least one airflow channel.

Preferably, the combustible heat source is a blind combustible heat source.

As used herein with reference to the invention, the term "blind" is used to describe a combustible heat source that does not include any airflow channels extending along the length of the combustible heat source through which air may be drawn for inhalation by a user.

Blind combustible heat sources according to the invention and non-blind combustible heat sources according to the invention may comprise one or more closed or blocked channels through which air may not be drawn for inhalation by a user.

For example, the combustible heat source may comprise one or more closed channels that extend only part way along the length of the combustible heat source.

The inclusion of one or more closed channels may increase the surface area of the combustible heat source that is exposed to oxygen from the air. This may advantageously facilitate ignition and sustained combustion of the combustible heat source.

Aerosol-generating articles according to the invention comprise a combustible heat source according to the invention and an aerosol-forming substrate.

As used herein with reference to the invention, the term "aerosol-forming substrate" is used to describe a substrate comprising aerosol-forming material capable of releasing upon heating volatile compounds, which can form an aerosol. The aerosols generated from aerosol-forming substrates of aerosol-generating articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

The aerosol-forming substrate is downstream of the combustible heat source. That is, the aerosol-forming substrate is between the combustible heat source and the distal end of the aerosol-generating article.

The aerosol-forming substrate may abut the combustible heat source.

The aerosol-forming substrate may be longitudinally spaced-apart from the combustible heat source.

Advantageously, the aerosol-forming substrate comprises aerosol-forming material comprising an aerosol-former.

The aerosol former may be any suitable compound or mixture of compounds that, in use, facilitates formation of a dense and stable aerosol and that is substantially resistant to thermal degradation at the operating temperature of the aerosol-generating article. Suitable aerosol formers are known in the art and include, but are not limited to: polyhydric alcohols, such as triethylene glycol, propylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Advantageously, the aerosol former comprises one or more polyhydric alcohols.

More advantageously, the aerosol former comprises glycerine.

Preferably, the aerosol-forming substrate is a solid aerosol-forming substrate. The aerosol-forming substrate may comprise both solid and liquid components.

The aerosol-forming substrate may comprise plant-based material. The aerosol-forming substrate may comprise homogenised plant-based material.

The aerosol-forming substrate may comprise nicotine.

The aerosol-forming substrate may comprise tobacco material.

As used herein with reference to the invention, the term "tobacco material" is used to describe any material comprising tobacco, including, but not limited to, tobacco leaf, tobacco rib, tobacco stem, tobacco stalk, tobacco dust, expanded tobacco, reconstituted tobacco material and homogenised tobacco material.

The tobacco material may, for example, be in the form of powder, granules, pellets, shreds, strands, strips, sheets or any combination thereof.

Advantageously, the aerosol-forming substrate comprises homogenised tobacco material.

As used herein with reference to the invention, the term "homogenised tobacco material" is used to describe a material formed by agglomerating particulate tobacco.

In certain embodiments, the aerosol-forming substrate advantageously comprises a plurality of strands of homogenised tobacco material.

Advantageously, the plurality of strands of homogenised tobacco material may be aligned substantially parallel to one another within the aerosol-forming substrate.

In certain embodiments, the aerosol-forming substrate advantageously comprises a gathered sheet of homogenised tobacco material.

The aerosol-forming substrate may comprise a rod comprising a gathered sheet of homogenised tobacco material.

As used herein with reference to the invention, the term "rod" is used to describe a substantially cylindrical element of substantially circular, oval or elliptical cross-section.

As used herein with reference to the invention, the term "sheet" is used to describe a laminar element having a width and length substantially greater than the thickness thereof.

As used herein with reference to the invention, the term "gathered" is used to describe a sheet that is convoluted, folded, or otherwise compressed or constricted substantially transversely to the longitudinal axis of the aerosol-generating article.

The aerosol-forming substrate may comprise aerosol-forming material and a wrapper around and in contact with the aerosol-forming material.

The wrapper may be formed from any suitable sheet material that is capable of being wrapped around aerosol-forming material to form an aerosol-forming substrate.

In certain embodiments, the aerosol-forming substrate may comprise a rod comprising a gathered sheet of homogenised tobacco material and a wrapper around and in contact with the tobacco material.

In certain embodiments, the aerosol-forming substrate advantageously comprises a gathered textured sheet of homogenised tobacco material.

As used herein with reference to the invention, the term "textured sheet" is used to describe a sheet that has been crimped, embossed, debossed, perforated or otherwise deformed.

Use of a textured sheet of homogenised tobacco material may advantageously facilitate gathering of the sheet of homogenised tobacco material to form the aerosol-forming substrate.

The aerosol-forming substrate may comprise a gathered textured sheet of homogenised tobacco material comprising a plurality of spaced-apart indentations, protrusions, perforations or any combination thereof.

The aerosol-forming substrate may comprise a gathered crimped sheet of homogenised tobacco material.

As used herein with reference to the invention, the term "crimped sheet" is used to describe a sheet having a plurality of substantially parallel ridges or corrugations.

Advantageously, when an aerosol-generating article according to the invention comprising the aerosol-forming substrate has been assembled, the substantially parallel ridges or corrugations extend along or parallel to the longitudinal axis of the aerosol-generating article. This facilitates gathering of the crimped sheet of homogenised tobacco material to form the aerosol-forming substrate.

However, it will be appreciated that crimped sheets of homogenised tobacco material for inclusion in aerosol-forming substrates of aerosol-generating articles according to the invention may alternatively or in addition have a plurality of substantially parallel ridges or corrugations that are disposed at an acute or obtuse angle to the longitudinal axis of the aerosol-generating article when the aerosol-generating article has been assembled.

Preferably, the aerosol-forming substrate is substantially cylindrical.

The aerosol-forming substrate may have a length of between about 5 millimetres and about 20 millimetres.

Preferably, the aerosol-forming substrate has a length of between about 6 millimetres and about 15 millimetres.

More preferably, the aerosol-forming substrate has a length of between about 7 millimetres and about 12 millimetres.

The aerosol-forming substrate may have a diameter of between about 5 millimetres and about 15 millimetres.

Preferably, the aerosol-forming substrate has a diameter of between about 5 millimetres and about 10 millimetres More preferably, the aerosol-forming substrate has a diameter of between about 7 millimetres and about 8 millimetres.

Aerosol-generating articles according to the invention may comprise a combustible heat source according to the invention, an aerosol-forming substrate downstream of the combustible heat source and one or more other components.

The combustible heat source, the aerosol-forming substrate and, where included, the one or more other components of the aerosol-generating article may be assembled within one or more wrappers to form an elongate rod having a proximal end and an opposed distal end. Aerosol-generating articles according to the invention may thus resemble conventional lit-end cigarettes.

The one or more other components may comprise one or more of a cap, a transfer element or spacer element, an aerosol-cooling element or heat exchanger and a mouthpiece.

Aerosol-generating articles according to the invention may comprise a cap configured to at least partially cover a front portion of the combustible heat source. The cap may be removable to expose the front portion of the combustible heat source prior to use of the aerosol-generating article. The cap may advantageously protect the combustible heat source prior to use of the aerosol-generating article.

As used herein with reference to the invention, the term "cap" is used to describe a protective cover at the distal end of the aerosol-generating article that substantially surrounds a front portion of the combustible heat source.

For example, aerosol-generating articles according to the invention may comprise a removable cap attached at a line of weakness to the distal end of the aerosol-generating article, wherein the cap comprises a cylindrical plug of material circumscribed by a wrapper as described in WO 2014/086998 A1.

Aerosol-generating articles according to the invention may comprise a transfer element or spacer element downstream of the aerosol-forming substrate. That is, a transfer element or spacer element located between the aerosol-forming substrate and the proximal end of the aerosol-generating article.

The transfer element may abut the aerosol-forming substrate. Alternatively, the transfer element may be longitudinally spaced-apart from the aerosol-forming substrate.

The inclusion of a transfer element may advantageously allow cooling of the aerosol generated by heat transfer from the combustible heat source to the aerosol-forming substrate.

The inclusion of a transfer element may advantageously allow the overall length of the aerosol-generating article to be adjusted to a desired value through an appropriate choice of the length of the transfer element. For example, the inclusion of a transfer element may allow the overall length of the aerosol-generating article to be adjusted to a length similar to that of a conventional cigarette.

The transfer element may have a length of between about 7 millimetres and about 50 millimetres. For example, the transfer element may have a length of between about 10 millimetres and about 45 millimetres or a length of between about 15 millimetres and about 30 millimetres.

The transfer element may have other lengths depending upon the desired overall length of the aerosol-generating article and the presence and length of other components within the aerosol-generating article.

The transfer element may comprise an open-ended tubular hollow body. In use, air drawn into the aerosol-generating article by a user may pass through the open-ended tubular hollow body as it passes downstream through the aerosol-generating article from the aerosol-forming substrate to the proximal end of the aerosol-generating article.

The open-ended tubular hollow body may be formed from one or more materials that are substantially thermally stable at the temperature of the aerosol generated by the transfer of heat from the combustible heat source to the aerosol-forming substrate. Suitable materials are known in the art and include, but are not limited to: paper; cardboard; thermoplastics, such a cellulose acetate; and ceramics.

Aerosol-generating articles according to the invention may comprise an aerosol-cooling element or heat exchanger downstream of the aerosol-forming substrate. That is, an aerosol-cooling element or heat exchanger located between the aerosol-forming substrate and the proximal end of the aerosol-generating article.

The aerosol-cooling element may advantageously cool the aerosol generated by heat transfer from the combustible heat source to the aerosol-forming substrate.

The aerosol-cooling element may comprise a plurality of longitudinally extending channels.

The aerosol-cooling element may comprise a gathered sheet of material selected from the group consisting of metallic foil, polymeric material, and substantially non-porous paper or cardboard.

The aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

The aerosol-cooling element may comprise a gathered sheet of biodegradable polymeric material, such as polylactic acid (PLA) or a grade of Mater-Bi® (a commercially available family of starch based copolyesters).

Where aerosol-generating articles according to the invention comprise a transfer element downstream of the aerosol-forming substrate and an aerosol-cooling element downstream of the aerosol-forming substrate, the aerosol-cooling element is preferably downstream of the transfer element. That is, the aerosol-cooling element is preferably located between the transfer element and the proximal end of the aerosol-generating article.

Aerosol-generating articles according to the invention may comprise a mouthpiece downstream of the aerosol-forming substrate. That is, a mouthpiece located between the aerosol-aerosol-forming and the proximal end of the aerosol-generating article.

Preferably, aerosol-generating articles according to the invention comprise a mouthpiece located at the proximal end of the aerosol-generating article.

The mouthpiece may be of low filtration efficiency or very low filtration efficiency.

The mouthpiece may be a single segment mouthpiece.

The mouthpiece may be a multi-segment mouthpiece.

The mouthpiece may comprise one or more segments comprising filtration material.

Suitable filtration materials are known in the art and include, but are not limited to, cellulose acetate and paper.

The mouthpiece may comprise one or more segments comprising absorbent material.

The mouthpiece may comprise one or more segments comprising adsorbent material.

Suitable absorbent materials and suitable adsorbent materials are known in the art and include, but are not limited to, activated carbon, silica gel and zeolites.

Aerosol-generating articles according to the invention may comprise one or more aerosol modifying agents downstream of the aerosol-forming substrate. For example, where included, one or more of the mouthpiece, transfer element and aerosol-cooling element of aerosol-generating articles according to the invention may comprise one or more aerosol modifying agents.

As used herein with reference to the invention, the term "aerosol-modifying agent" is used to describe an agent that, in use, modifies one or more features or properties of an aerosol generated by the aerosol-forming substrate of the aerosol-generating article.

Suitable aerosol-modifying agents include, but are not limited to, flavourants and chemesthetic agents.

As used herein with reference to the invention, the term "chemesthetic agent" is used to describe an agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Aerosol-generating articles according to the invention may comprise one or more aerosol modifying agents that are both a flavourant and a chemesthetic agent downstream of the aerosol-forming substrate. For example, where included, one or more of the mouthpiece, transfer element and aerosol-cooling element of aerosol-generating articles according to the invention may comprise menthol or another flavourant that provides a cooling chemesthetic effect.

Aerosol-generating articles according to the invention may comprise one or more heat-conducting elements.

Preferably, the aerosol-generating articles according to the invention comprise a heat-conducting element around at least a portion of the aerosol-forming substrate. The heat-conducting element may advantageously transfer heat to the periphery of the aerosol-forming substrate by conduction.

More preferably, aerosol-generating articles according to the invention comprise a heat-conducting element around and in contact with at least a portion of the aerosol-forming substrate. This may advantageously facilitate conductive heat transfer to the periphery of the aerosol-forming substrate.

The heat-conducting element may be around the entire length of the aerosol-forming substrate. That is, the heat-conducting element may overlie the entire length of the aerosol-forming substrate.

Preferably, the heat-conducting element is not around a rear portion of the aerosol-forming substrate. That is, the aerosol-forming substrate advantageously extends longitudinally beyond the heat-conducting element in a downstream direction.

Preferably, the aerosol-forming substrate extends longitudinally at least about 3 millimetres beyond the heat-conducting element in a downstream direction.

Preferably, aerosol-generating articles according to the invention comprise a heat-conducting element around at least a portion of the combustible heat source and around at least a portion of the aerosol-forming substrate.

More preferably, aerosol-generating articles according to the invention comprise a heat-conducting element around at least a rear portion of the combustible heat source and around at least a front portion of the aerosol-forming substrate.

Most preferably, aerosol-generating articles according to the invention comprise a heat-conducting element around and in contact with at least a rear portion of the combustible heat source and around and in contact with at least a front portion of the aerosol-forming substrate.

The heat-conducting element may provide a thermal link between the combustible heat source and the aerosol-forming substrate of the aerosol-generating article. This may advantageously help to facilitate adequate heat transfer from the combustible heat source to the aerosol-forming substrate to produce an acceptable aerosol.

Preferably, the rear portion of the heat source in contact with the heat-conducting element is between about 2 millimetres and about 8 millimetres in length.

More preferably, the rear portion of the heat source in contact with the heat-conducting element is between about 3 millimetres and about 5 millimetres in length.

Preferably, the heat-conducting element is non-combustible.

The heat conducting element may be oxygen restricting. In other words, the heat-conducting element may inhibit or resist the passage of oxygen through the heat-conducting element.

The heat-conducting element may be formed from any suitable thermally conductive material or combination of materials.

Preferably, the heat-conducting element comprises one or more heat-conductive materials having a bulk thermal conductivity of between about 10 W per metre Kelvin (W/(m·K)) and about 500 W per metre Kelvin (W/(m·K)), more preferably between about 15 W per metre Kelvin (W/(m·K)) and about 400 W per metre Kelvin (W/(m·K)), at 23 degrees Celsius and a relative humidity of 50 percent as measured using the modified transient plane source (MTPS) method.

Advantageously, the heat-conducting elements comprises one or more metals, one or more alloys or a combination of one or more metals and one or more alloys.

Suitable thermally conductive materials are known in the art and include, but are not limited to: metal foils, such as, for example, aluminium foil, iron foil and copper foil; and alloy foils, such as, for example, steel foil.

Advantageously, the heat-conducting element comprises aluminium foil.

Aerosol-generating articles according to the invention may comprise a non-combustible substantially air impermeable barrier between a rear end face of the combustible heat source and the aerosol-forming substrate.

Inclusion of a non-combustible substantially air impermeable barrier between a rear end face of the combustible heat source and the aerosol-forming substrate may advantageously limit the temperature to which the aerosol-forming substrate is exposed during ignition and combustion of the combustible heat source. This may help to avoid or reduce thermal degradation or combustion of the aerosol-forming substrate during use of the aerosol-generating article.

Inclusion of a non-combustible substantially air impermeable barrier between the rear end face of the combustible heat source and the aerosol-forming substrate may advantageously substantially prevent or inhibit migration of components of the aerosol-forming substrate to the combustible heat source during storage and use of the aerosol-generating article.

The barrier may abut one or both of the rear end face of the combustible heat source and the aerosol-forming substrate. Alternatively, the barrier may be longitudinally spaced apart from one or both of the rear end face of the combustible heat source and the aerosol-forming substrate.

Advantageously, the barrier is adhered or otherwise affixed to the rear end face of the combustible heat source.

Suitable methods for adhering or affixing a barrier to the rear end face of the combustible heat source are known in the art and include, but are not limited to: spray-coating; vapour deposition; dipping; material transfer (for example, brushing or gluing); electrostatic deposition; pressing; or any combination thereof.

The barrier between the rear end face of the combustible heat source and the aerosol-forming substrate may have a low thermal conductivity or a high thermal conductivity. For example, the barrier may be formed from material having a bulk thermal conductivity of between about 0.1 W per metre Kelvin (W/(m·K)) and about 200 W per metre Kelvin (W/(m·K)), at 23 degrees Celsius and a relative humidity of 50 percent as measured using the modified transient plane source (MTPS) method.

The thickness of the barrier between the rear end face of the combustible heat source and the aerosol-forming substrate may be selected to achieve good performance. For example, the barrier may have a thickness of between about 10 micrometres and about 500 micrometres.

The barrier between the rear end face of the combustible heat source and the aerosol-forming substrate may be formed from one or more suitable materials that are substantially thermally stable and non-combustible at temperatures achieved by the combustible heat source during ignition and combustion thereof. Suitable materials are known in the art and include, but are not limited to: clays such as, for example, bentonite and kaolinite; glasses; minerals; ceramic materials; resins; metals; or any combination thereof.

Preferably, the barrier comprises aluminium foil.

A barrier of aluminium foil may be applied to the rear end face of the combustible heat source by gluing or pressing it to the combustible heat source. The barrier may be cut or otherwise machined so that the aluminium foil covers and adheres to at least substantially the entire rear end face of the combustible heat source. Advantageously, the aluminium foil covers and adheres to the entire rear end face of the combustible heat source.

Aerosol-generating articles according to the invention may comprise a non-blind combustible heat source according to the invention.

Where the combustible heat source is a non-blind combustible heat source, in use air drawn through the aerosol-generating article for inhalation by a user passes through at least one airflow channel along the length of the combustible heat source.

Where the combustible heat source is a non-blind combustible heat source, heating of the aerosol-forming substrate occurs by conduction and forced convection.

Where aerosol-generating articles according to the invention comprise a non-blind combustible heat source according to the invention and a non-combustible substantially air impermeable barrier between a rear end face of the combustible heat source and the aerosol-forming substrate, the barrier should allow air drawn through at least one airflow channel extending along the length of the combustible heat source to be drawn downstream through the aerosol-generating article.

Preferably, aerosol-generating articles according to the invention comprise a blind combustible heat source according to the invention.

Where the combustible heat source is a blind combustible heat source, in use air drawn through the aerosol-generating article for inhalation by a user does not pass through any airflow channels along the length of the blind combustible heat source.

Where the combustible heat source is a blind combustible heat source, heating of the aerosol-forming substrate occurs primarily by conduction and heating of the aerosol-forming substrate by forced convection is minimised or reduced. In such embodiments, it is particularly important to optimise the conductive heat transfer between the combustible heat source and the aerosol-forming substrate.

The lack of any airflow channels extending along the length of the combustible heat source through which air may be drawn for inhalation by a user may advantageously substantially prevent or inhibit activation of combustion of the blind combustible heat source during puffing by a user. This may advantageously substantially prevent or inhibit spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

Inclusion of a blind combustible heat source may advantageously substantially prevent or inhibit combustion and decomposition products and other materials formed during ignition and combustion of the blind combustible heat source from entering air drawn through the aerosol-generating article for inhalation by a user.

Where the combustible heat source is a blind combustible heat source, aerosol-generating articles according to the invention comprise one or more air inlets downstream of the blind combustible heat source for drawing air into the aerosol-generating article for inhalation by a user.

In such embodiments, air drawn through the aerosol-generating article for inhalation by a user enters the aerosol-generating article through the one or more air inlets and not through the distal end of the aerosol-generating article.

Where the combustible heat source is a non-blind combustible heat source, aerosol-generating articles according to the invention may also comprise one or more air inlets downstream of the non-blind combustible heat source for drawing air into the aerosol-generating article for inhalation by a user.

Aerosol-generating articles according to the invention may comprise one or more air inlets around the periphery of the aerosol-forming substrate.

In such embodiments, during puffing by a user cool air is drawn into the aerosol-forming substrate of the aerosol-generating article through the one or more air inlets around the periphery of the aerosol-forming substrate. This may advantageously reduce the temperature of the aerosol-forming substrate and so substantially prevent or inhibit spikes in the temperature of the aerosol-forming substrate during puffing by a user.

As used herein with reference to the invention, the term "cool air" is used to describe ambient air that is not significantly heated by the combustible heat source upon puffing by a user.

By preventing or inhibiting spikes in the temperature of the aerosol-forming substrate, the inclusion of one or more air inlets around the periphery of the aerosol-forming substrate, may advantageously help to avoid or reduce combustion or pyrolysis of the aerosol-forming substrate under intense puffing regimes.

Inclusion of one or more air inlets around the periphery of the aerosol-forming substrate may advantageously help to minimise or reduce the impact of a user's puffing regime on the composition of the mainstream aerosol of the aerosol-generating article.

In certain preferred embodiments, aerosol-generating articles according to the invention may comprise one or more air inlets located proximate to a downstream end of the aerosol-forming substrate.

Aerosol-generating articles according to the invention may have any desired length.

Preferably, aerosol-generating articles according to the invention may have a length of between about 65 millimetres and about 100 millimetres.

Aerosol-generating articles according to the invention may have any desired width.

Preferably, aerosol-generating articles according to the invention may have a width of between about 5 millimetres and about 12 millimetres.

Aerosol-generating articles according to the invention may be assembled using known methods and machinery.

For the avoidance of doubt, where applicable, features described above in relation to combustible heat sources according to the invention may also be applied to aerosol-generating articles according to the invention and vice versa.

Figure 2:
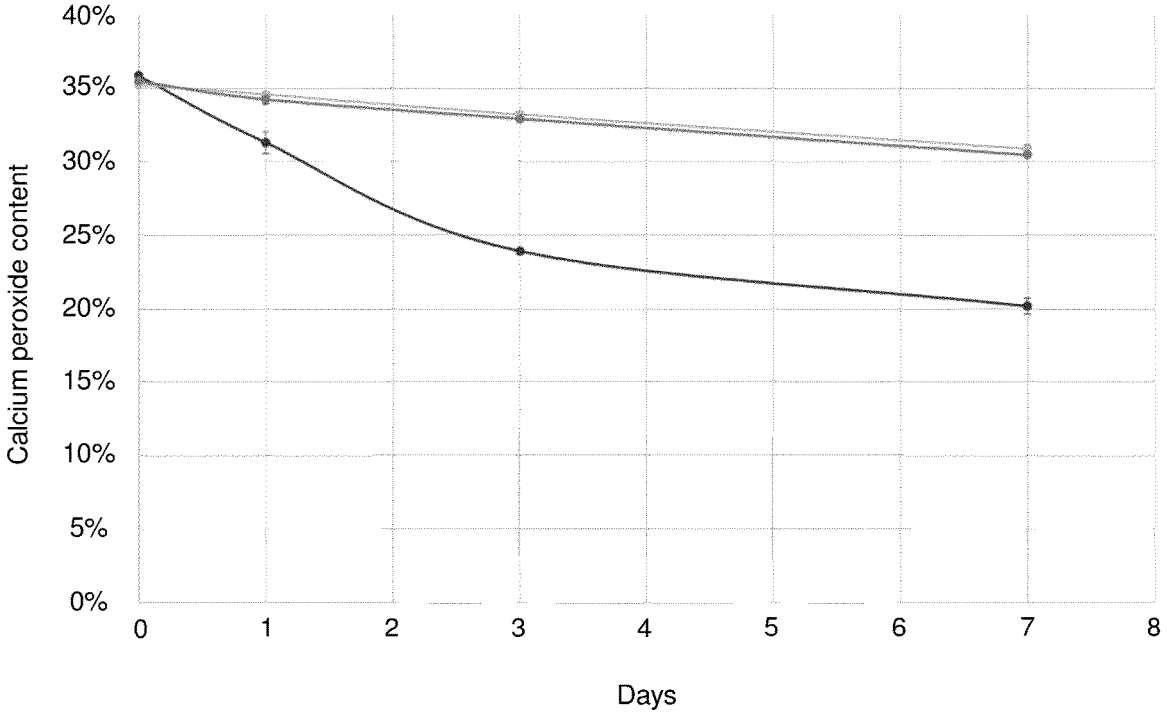

The invention will be further described, by way of example only, with reference to the accompanying drawings in which:

FIG. 1 shows a schematic longitudinal cross-section of an aerosol-generating article according to an embodiment of the invention; and FIG. 2 shows a graph of the calcium peroxide content of a combustible heat source according to a first embodiment of the invention, a combustible heat source according to a second embodiment of the invention and a comparative combustible heat source not according to the invention as a function of time.

The aerosol-generating article 2 according to the embodiment of the invention shown in FIG. 1 comprises a combustible heat source 4 according to the invention and an aerosol-forming substrate 10 downstream of the combustible heat source 4. The combustible heat source 4 is a blind combustible heat source having a front end face 6 and an opposed rear end face 8 and is located at the distal end of the aerosol-generating article 2. The aerosol-generating article 2 further comprises a transfer element 12, an aerosol-cooling element 14, a spacer element 16 and a mouthpiece 18. The combustible heat source 4, aerosol-forming substrate 10, transfer element 12, aerosol-cooling element 14, spacer element 16 and mouthpiece 18 are arranged in abutting coaxial alignment. As shown in FIG. 1, the aerosol-forming substrate 10, transfer element 12, aerosol-cooling element 14, spacer element 16 and mouthpiece 18 and a rear portion of the combustible heat source 4 are wrapped in an outer wrapper 20 of sheet material such as, for example, cigarette paper.

As shown in FIG. 1, a non-combustible substantially air impermeable barrier 22 in the form of a disc of aluminium foil is provided between the rear end face 8 of the combustible heat source 4 and the aerosol-forming substrate 10. The barrier 22 is applied to the rear end face 8 of the combustible carbonaceous heat source 4 by pressing the disc of aluminium foil onto the rear end face 8 of the combustible heat source 4 and abuts the rear end face 8 of the combustible carbonaceous heat source 4 and the aerosol-forming substrate 10.

The combustible heat source 4 comprises carbon, an alkaline earth metal peroxide ignition aid, and a binding agent comprising at least one non-cellulosic film-forming polymer.

The aerosol-forming substrate 10 is located immediately downstream of the barrier 22 applied to the rear end face 8 of the combustible heat source 4. The aerosol-forming substrate 10 comprises a gathered crimped sheet of homogenised tobacco material 24 and a wrapper 26 around and in direct contact with the gathered crimped sheet of homogenised tobacco material 24. The gathered crimped sheet of homogenised tobacco material 24 comprises a suitable aerosol former such as, for example, glycerine.

The transfer element 12 is located immediately downstream of the aerosol-forming substrate 10 and comprises a cylindrical open-ended hollow cellulose acetate tube 28.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube.

The mouthpiece 18 is located immediately downstream of the spacer element 16. As shown in FIG. 1, the mouthpiece 18 is located at the proximal end of the aerosol-generating article 2 and comprises a cylindrical plug of suitable filtration material 30 such as, for example, cellulose acetate tow of very low filtration efficiency, wrapped in filter plug wrap 32.

The aerosol-generating article may further comprise a band of tipping paper (not shown) circumscribing a downstream end portion of the outer wrapper 20.

As shown in FIG. 1, the aerosol-generating article 2 further comprises a heat-conducting element 34 formed from a suitable thermally conductive material such as, for example, aluminium foil around and in contact with a rear portion 4*b* of the combustible heat source 4 and a front portion 10*a* of the aerosol-forming substrate 10. In the aerosol-generating article 2 according to the embodiment of the invention shown in FIG. 1, the aerosol-forming substrate 10 extends downstream beyond the heat-conducting element 34. That is, the heat-conducting element 34 is not around and in contact with a rear portion of the aerosol-forming substrate 10. However, it will be appreciated that in other embodiments of the invention (not shown), the heat-conducting element 34 may be around and in contact with the entire length of the aerosol-forming substrate 10. It will also be appreciated that in other embodiments of the invention (not shown), one or more additional heat-conducting elements may be provided that overlie the heat-conducting element 34.

The aerosol-generating article 2 according to the embodiment of the invention shown in FIG. 1 comprises one or more air inlets 36 around the periphery of the aerosol-forming substrate 10. As shown in FIG. 1, a circumferential arrangement of air inlets 36 is provided in the wrapper 26 of the aerosol-forming substrate 10 and the overlying outer wrapper 20 to admit cool air (shown by dotted arrows in FIG. 1) into the aerosol-forming substrate 10.

In use, a user ignites the combustible carbonaceous heat source 4. Once the combustible carbonaceous heat source 4 is ignited the user draws on the mouthpiece 18 of the aerosol-generating article 2. When a user draws on the mouthpiece 18, cool air (shown by dotted arrows in FIG. 1) is drawn into the aerosol-forming substrate 10 of the aerosol-generating article 2 through the air inlets 36.

The periphery of the front portion 10*a* of the aerosol-forming substrate 10 is heated by conduction through the rear end face 8 of the combustible heat source 4 and the barrier 22 and through the heat-conducting element 34.

The heating of the aerosol-forming substrate 10 by conduction releases aerosol former and other volatile and semi-volatile compounds from the gathered crimped sheet of homogenised tobacco material 24. The compounds released from the aerosol-forming substrate 10 form an aerosol that is entrained in the air drawn into the aerosol-forming substrate 10 of the aerosol-generating article 2 through the air inlets 36 as it flows through the aerosol-forming substrate 10. The drawn air and entrained aerosol (shown by dashed arrows in FIG. 1) pass downstream through the interior of the cylindrical open-ended hollow cellulose acetate tube 28 of the transfer element 12, the aerosol-cooling element 14 and the spacer element 16, where they cool and condense. The cooled drawn air and entrained aerosol pass downstream through the mouthpiece 18 and are delivered to the user through the proximal end of the aerosol-generating article 2. The non-combustible substantially air impermeable barrier 22 on the rear end face 8 of the combustible carbonaceous heat source 4 isolates the combustible heat source 4 from air drawn through the aerosol-generating article 2 such that, in use, air drawn through the aerosol-generating article 2 does not come into direct contact with the combustible heat source 4.

The specific embodiments and examples described above illustrate but do not limit the invention. It is to be understood that other embodiments of the invention may be made and the specific embodiments and examples described herein are not exhaustive.

Combustible heat sources according to a first embodiment of the invention are produced having the composition shown in Table 1:

TABLE 1

| Component | Function | Content (percentage by weight) |
|---|---|---|
| Charcoal | Fuel | 43.3 |
| Calcium Peroxide (about 80 percent purity) | Alkaline earth metal peroxide ignition aid | 48.0 |
| Carboxymethyl cellulose | Binding agent | 4.7 |
| Polyvinyl alcohol | Binding agent | 2.0 |
| Tri-potassium citrate hydrate | Carboxylate burn salt | 2.0 |
| | Total | 100.0 |

The components in Table 1 are combined to form a granulate mixture by wet granulation. The charcoal, calcium peroxide and carboxymethyl cellulose are mixed to form a particulate mixture. The particulate mixture of charcoal, calcium peroxide and carboxymethyl cellulose is air fluidized and sprayed with a liquid solution of tri-potassium citrate hydrate and an aqueous solution of polyvinyl alcohol to form a granulate mixture.

The granulate mixture is formed into a cylindrical shape by pressing. About 400 milligrams of the granulate mixture is pressed in a single cavity press to form a cylindrical combustible heat source having a length of about 9 millimetres, a diameter of about 7.7 millimetres and a density of about 0.9 grams per cubic centimetre. The cylindrical combustible heat source is removed from the single cavity press and dried in a drying oven at a temperature of between about 85 degrees Celsius and about 105 degrees Celsius for about 3 hours.

Combustible heat sources according to a second embodiment of the invention are produced having the composition shown in Table 2:

TABLE 2

| Component | Function | Content (percentage by weight) |
|---|---|---|
| Charcoal | Fuel | 43.3 |
| Calcium Peroxide (about 80 percent purity) | Alkaline earth metal peroxide ignition aid | 48.0 |
| Carboxymethyl cellulose | Binding agent | 4.7 |
| Polyvinyl alcohol-polyethylene glycol graft-copolymer | Binding agent | 2.0 |
| Tri-potassium citrate hydrate | Carboxylate burn salt | 2.0 |
| | Total | 100.0 |

The components in Table 2 are combined to form a granulate mixture by wet granulation. The charcoal, calcium peroxide and carboxymethyl cellulose are mixed to form a particulate mixture. The particulate mixture of charcoal, calcium peroxide and carboxymethyl cellulose is air fluidized and sprayed with a liquid solution of tri-potassium citrate hydrate and an aqueous solution of polyvinyl alcohol-polyethylene glycol graft-copolymer to form a granulate mixture.

The granulate mixture is formed into a cylindrical shape by pressing. About 400 milligrams of the granulate mixture is pressed in a single cavity press to form a cylindrical combustible heat source having a length of about 9 millimetres, a diameter of about 7.7 millimetres and a density of about 0.9 grams per cubic centimetre. The cylindrical combustible heat source is removed from the single cavity press and dried in a drying oven at a temperature of between about 85 degrees Celsius and about 105 degrees Celsius for about 3 hours.

Comparative combustible heat sources not according to the invention having the composition shown in Table 3 are also produced:

TABLE 3

| Component | Function | Content (percentage by weight) |
|---|---|---|
| Charcoal | Fuel | 45.0 |
| Calcium Peroxide (about 80 percent purity) | Alkaline earth metal peroxide ignition aid | 48.0 |
| Carboxymethyl cellulose | Binding agent | 4.7 |
| Bentonite | Binding agent | 0.3 |
| Tri-potassium citrate hydrate | Carboxylate burn salt | 2.0 |
| | Total | 100.0 |

The components in Table 3 are combined to form a granulate mixture by wet granulation. The charcoal, calcium peroxide and carboxymethyl cellulose are mixed to form a particulate mixture. The particulate mixture of charcoal, calcium peroxide and carboxymethyl cellulose is air fluidized and sprayed with a liquid solution of tri-potassium citrate hydrate and then an aqueous solution of bentonite to form a granulate mixture.

The granulate mixture is formed into a cylindrical shape by pressing. About 400 milligrams of the granulate mixture is pressed in a single cavity press to form a cylindrical combustible heat source having a length of about 9 millimetres, a diameter of about 7.7 millimetres and a density of about 0.9 grams per cubic centimetre. The cylindrical combustible heat source is removed from the single cavity press and dried in a drying oven at a temperature of between about 85 degrees Celsius and about 105 degrees Celsius for about 3 hours.

To simulate environmental conditions to which combustible heat sources may be exposed during transport and storage, the combustible heat sources according to the first embodiment of the invention, the combustible heat sources according to the second embodiment of the invention and the comparative combustible heat sources not according to the invention are conditioned at about 30 degrees Celsius and about 75 percent relative humidity for 7 days. The calcium peroxide content (percentage by weight) of the combustible heat sources according to the first embodiment of the invention, the combustible heat sources according to the second embodiment of the invention and the comparative combustible heat sources not according to the invention is measured as a function of time by titration with potassium permanganate ($KMnO_4$) solution. The results are shown in FIG. 2; the upper line in FIG. 2 shows the measured calcium peroxide content of the combustible heat sources according to the first embodiment of the invention as a function of time, the middle line in FIG. 2 shows the measured calcium peroxide content of the combustible heat sources according to the second embodiment of the invention as a function of time and the lower line in FIG. 2 shows the measured calcium peroxide content of the comparative combustible heat sources not according to the invention as a function of time. The values shown in FIG. 2 are the average of the measurements for three replicates of each combustible heat source.

As shown in FIG. 2, the rate of degradation over time of the calcium peroxide in the combustible heat sources according to the first and second embodiments of the invention is advantageously significantly lower than the rate of degradation over time of the calcium peroxide in the comparative combustible heat sources not according to the invention.

The ignition propagation speed of ten combustible heat sources according to the first embodiment of the invention, ten combustible heat sources according to the second embodiment of the invention and ten comparative combustible heat sources not according to the invention is also measured. The results are shown in Table 4. The combustible heat sources according to the first embodiment of the invention, the combustible heat sources according to the second embodiment of the invention and the comparative combustible heat sources not according to the invention are conditioned at about 22 degrees Celsius and about 50 percent relative humidity for about 24 hours prior to measurement of the ignition propagation speed. To measure the ignition propagation speed, thermocouples are inserted into the combustible heat sources according to the first embodiment of the invention, the combustible heat sources according to the second embodiment of the invention and the comparative combustible heat sources not according to the invention at two positions, a first position 1 millimetre from the front end face of the combustible heat source and a second position 8 millimetres from the front end face of the combustible heat source. The front end faces of the combustible heat sources according to the first embodiment of the invention, the combustible heat sources according to the second embodiment of the invention and the comparative combustible heat sources not according to the invention are ignited using an electrical lighter. The difference in the time taken for the temperature measured by the thermocouples at the first position and the second position to reach 350 degrees Celsius is measured. The ignition propagation time shown in Table 4 is the average time measured for the ten combustible heat sources according to the first embodiment of the invention, ten combustible heat sources according to the second embodiment of the invention and ten comparative combustible heat sources not according to the invention.

TABLE 4

| | Ignition propagation time (seconds) |
|---|---|
| Combustible heat sources according to the first embodiment of the invention | 2.0 ± 0.1 |
| Combustible heat sources according to the second embodiment of the invention | 2.0 ± 0.2 |
| Comparative combustible heat sources not according to the invention | 3.0 ± 0.3 |

As shown in Table 4, the ignition propagation time of the combustible heat sources according to the first and second embodiments of the invention is advantageously significantly lower than the ignition propagation time of the comparative combustible heat sources not according to the invention.

The results in FIG. 2 and Table 4 demonstrate an improvement in the chemical and physical stability and combustion properties of combustible heat sources according to the invention due to the inclusion of a binding agent comprising at least one non-cellulosic film-forming polymer.

The results in FIG. 2 demonstrate that inclusion of a binding agent comprising at least one non-cellulosic film-forming polymer in combustible heat sources according to the invention advantageously significantly reduces degradation of the alkaline earth metal peroxide ignition aid as a result of exposure to environmental conditions. In particular, the results in FIG. 2 demonstrate that inclusion of a binding agent comprising at least one non-cellulosic film-forming polymer in combustible heat sources according to the invention advantageously significantly reduces degradation of the alkaline earth metal peroxide ignition aid as a result of exposure to high humidity.

The results in Table 4 demonstrate that inclusion of a binding agent comprising at least one non-cellulosic film-forming polymer in combustible heat sources according to the invention also advantageously significantly improves the ignition propagation speed of combustible heat sources according to the invention.

The invention claimed is:

1. A combustible heat source for an aerosol-generating article, the combustible heat source comprising:

carbon;

an alkaline earth metal peroxide ignition aid; and a binding agent comprising a combination of carboxymethyl cellulose and at least one non-cellulosic film-forming polymer selected from the group consisting of polyvinyl alcohol, polyethylene glycol, polyvinylpyrrolidone, polyvinyl acetate and graft-copolymers thereof.

2. The combustible heat source according to claim 1 wherein the alkaline earth metal peroxide ignition aid is calcium peroxide.

3. The combustible heat source according to claim 1 wherein the combustible heat source comprises between about 20 percent by weight and about 60 percent by weight of the alkaline earth metal peroxide ignition aid.

4. The combustible heat source according to claim 1 wherein the combustible heat source comprises at least about 3 percent by weight of the binding agent.

5. The combustible heat source according to claim 1 wherein the combustible heat source comprises between about 4 percent by weight and about 15 percent by weight of the binding agent.

6. The combustible heat source according to claim 1 wherein the combustible heat source comprises at least about 0.5 percent by weight of the at least one non-cellulosic film-forming polymer.

7. The combustible heat source according to claim 1 wherein the combustible heat source comprises between about 0.75 percent by dry weight and about 4 percent by weight of the at least one non-cellulosic film-forming polymer.

8. The combustible heat source according to claim 1 wherein the carboxymethyl cellulose is present in the combustible heat source in an amount of at least about 1.5 percent by dry weight.

9. The combustible heat source according to claim 8 wherein the ratio of the percentage by weight of carboxymethyl cellulose to the percentage by weight of the at least one non-cellulosic film-forming polymer in the combustible heat source is at least about 1:1.

10. The combustible heat source according to claim 1 wherein the combustible heat source comprises between about 30 percent by weight and about 55 percent by weight of carbon.

11. The combustible heat source according to claim 1 further comprising one or more carboxylate burn salts.

12. The combustible heat source according to claim 11 wherein the combustible heat source comprises at least about 1 percent by weight of the one or more carboxylate burn salts.

13. An aerosol-generating article comprising:

the combustible heat source according to claim 1; and an aerosol-forming substrate downstream of the combustible heat source.

14. The combustible heat source of claim 1, wherein the combustible heat source is substantially homogeneous in composition.

15. The combustible heat source of claim 1, wherein the carbon, alkaline earth metal peroxide ignition aid, and binding agent are combined to form a mixture.

16. The combustible heat source of claim 1, wherein the alkaline earth metal peroxide ignition aid, the binding agent and any other components of the combustible heat source form a granulate mixture, wherein the binding agent is dispersed in inter-granular and intra-granular positions within the granulate mixture.

* * * * *